US010203098B1

(12) United States Patent
Pan

(10) Patent No.: US 10,203,098 B1
(45) Date of Patent: Feb. 12, 2019

(54) DUAL-USE SIDE-LIGHTING NETTING LAMP BOX

(71) Applicant: Guojun Pan, Shanghai (CN)

(72) Inventor: Guojun Pan, Shanghai (CN)

( * ) Notice: Subject to any disclaimer, the term of this patent is extended or adjusted under 35 U.S.C. 154(b) by 0 days.

(21) Appl. No.: 15/912,771

(22) Filed: Mar. 6, 2018

(51) Int. Cl.

| | |
|---|---|
| ***F21V 21/00*** | (2006.01) |
| ***F21V 21/02*** | (2006.01) |
| ***F21V 33/00*** | (2006.01) |
| ***A47B 13/12*** | (2006.01) |
| ***G09F 13/04*** | (2006.01) |
| *G09F 13/22* | (2006.01) |
| *F21Y 115/10* | (2016.01) |

(52) U.S. Cl.
CPC ..... *F21V 21/025* (2013.01); *A47B 13/12* (2013.01); *F21V 33/0024* (2013.01); *G09F 13/0404* (2013.01); *F21Y 2115/10* (2016.08); *G09F 2013/222* (2013.01)

(58) Field of Classification Search
CPC ... F21V 21/025; F21V 33/0024; A47B 13/12; G09F 13/0404
See application file for complete search history.

(56) References Cited

U.S. PATENT DOCUMENTS

| | | | | |
|---|---|---|---|---|
| 9,410,692 | B2 * | 8/2016 | Wang | F21V 33/0012 |
| 9,681,759 | B2 * | 6/2017 | Schwalbach | A47F 3/001 |
| 2004/0231570 | A1 * | 11/2004 | Landa | A47B 13/12 108/28 |

FOREIGN PATENT DOCUMENTS

JP WO 2014087557 A1 * 6/2014 ..... A47B 13/12

* cited by examiner

*Primary Examiner* — Karabi Guharay
(74) *Attorney, Agent, or Firm* — Maier & Maier, PLLC

(57) ABSTRACT

A dual-use side-lighting netting lamp box with a box body. The box body has a top frame structure and a bottom frame structure. The top frame structure is formed by assembling short cross rod profiles and long cross rod profiles through top netting fixing blocks; and the bottom frame structure is formed by assembling short cross rod profiles and long cross rod profiles through bottom netting fixing blocks. A table surface at the top of the lamp box adopts a detachable structure, so that the lamp box can be used as not only a lamp box table when the table surface is placed normally, but also a single lamp box when the table surface is removed. Thus, the dual-use function is realized, the functionality of the lamp box is obviously improved, and the resource utilization rate is high.

5 Claims, 2 Drawing Sheets

DUAL-USE SIDE-LIGHTING NETTING LAMP BOX

FIELD

The present utility model belongs to the technical field of lamp boxes, and particularly relates to a dual-use side-lighting netting lamp box.

BACKGROUND

Generally, lamp boxes are formed by light sheets, and preferably by PC boards which are resistant to the highest temperature of 145° C., and the lowest temperature of −55° C. The lamp boxes are classified into ultra-thin lamp boxes, plastic-absorbing lamp boxes, rolling lamp boxes, crystal lamp boxes, fabric lamp boxes, electronic lamp boxes, EL lamp boxes, LED lamp boxes, acrylic lamp boxes, aluminum profile lamp boxes, FRP (glass fiber reinforced plastics) lamp boxes, stainless steel lamp boxes and the like according to the materials thereof.

However, the existing lamp boxes are inconvenient to use. Integrated structures of these lamp boxes directly increase the transportation cost; and the existing lamp boxes further have the problems of monotonous functions and low resource utilization rates, which need to be solved.

SUMMARY

An object of the present utility model is to provide a dual-use side-lighting netting lamp box so as to solve the problems in the prior art that the existing lamp boxes are high in transportation cost due to their integrated structures, monotonous in functions and low in resource utilization rates.

To achieve the above object, the present utility model provides the following technical solution. A dual-use side-lighting netting lamp box comprises a box body, wherein the box body consists of a top frame structure and a bottom frame structure. The top frame structure is formed by assembling short cross rod profiles and long cross rod profiles through top netting fixing blocks; and the bottom frame structure is formed by assembling short cross rod profiles and long cross rod profiles through bottom netting fixing blocks. There are four groups of the top netting fixing blocks and the bottom netting fixing blocks corresponding to each other. The four top netting fixing blocks and the corresponding four bottom netting fixing blocks are connected through upright rod profiles. A cross rod netting fixing block is mounted at the inner side of the long rod cross rod profile of each of the top and bottom frame structures through a cross rod end cap; and an upright rod netting fixing block is mounted at the inner side of each upright rod profile through an upright rod end cap. A table surface is mounted at the top of the box body; and a box body netting fixing block is mounted at the center of each of the front side surface and the rear side surface of the box body. The top, upright rod, bottom, cross rod and box body netting fixing blocks are connected into a crossed mesh structure through square netting pipe profiles. Feet are mounted at the two lower ends of the bottom frame structure of the box body, respectively. An LED modular lamp bead is mounted on the upper surface of the bottom frame structure of the box body through an LED modular lamp bead fixing block; and another LED modular lamp bead is mounted on the lower surface of the top frame structure of the box body through another LED modular lamp bead fixing block. A parallel wiring groove is formed in one side of the two LED modular lamp beads; and the two LED modular lamp beads are electrically connected with each other through a wire in the parallel wiring groove.

Preferably, an adjusting screw is mounted at the bottom of the cross rod netting fixing block.

Preferably, the box body netting fixing blocks on the front and rear side surfaces of the box body correspond to each other, and are connected with each other through a limiting rod.

Preferably, LED beads are intensively mounted on the inner side surface of the LED modular lamp bead.

Preferably, a U-shaped groove is formed in the outer side edge of the upright rod profile, and a stretched fabric is embedded into the U-shaped groove through a silica gel strip.

Compared with the prior art, the present utility model has the following beneficial effects. The dual-use side-lighting netting lamp box is more scientific and reasonable in structure, and safer and more convenient to use. The table surface at the top of the lamp box adopts a detachable structure, so that the lamp box can be used as not only a lamp box table when the table surface is placed normally, but also a single lamp box when the table surface is removed. Thus, the dual-use function is realized, the functionality of the lamp box is obviously improved, and the resource utilization rate is high. Meanwhile, the whole structure of the lamp box can be completely disassembled as it is formed by assembling a plurality of profiles, so that transportation and storage spaces are saved. Therefore, the lamp box is low in transportation cost, highly practical, and highly competitive.

Figure 1:
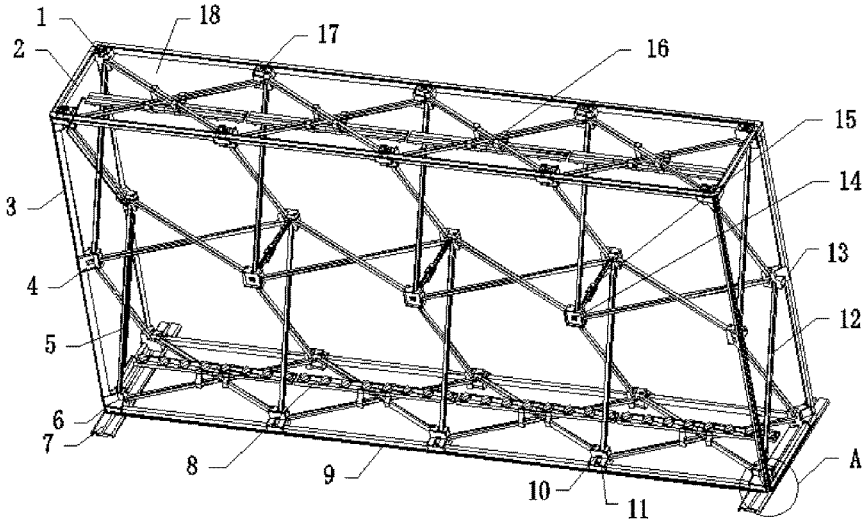
FIG. 1 is a schematically structural view of a lamp box provided by the present utility model.
Figure 2:
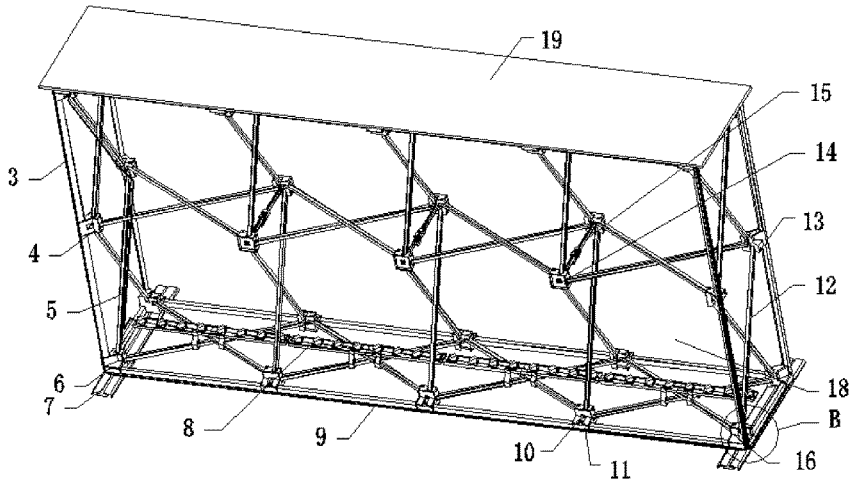
FIG. 2 is another schematically structural view of the lamp box provided by the present utility model.
Figure 3:
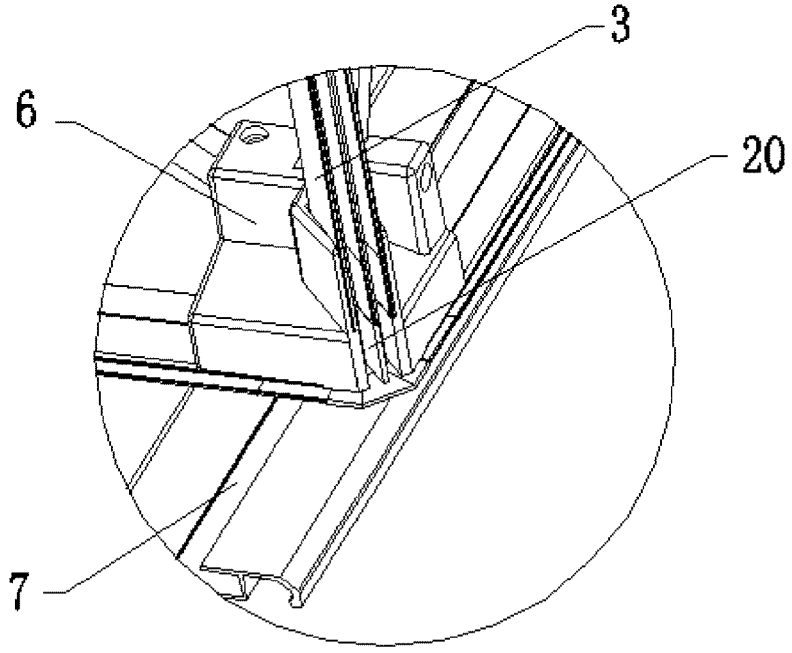
FIG. 3 is a partial enlarged view of a portion A in FIG. 1.

Description of the reference numerals in the figures: 1, top netting fixing block; 2, short cross rod profile; 3, upright rod profile; 4, upright rod netting fixing block; 5, parallel wiring groove; 6, bottom netting fixing block; 7, foot; 8, LED modular lamp bead; 9, long cross rod profile; 10, cross rod netting fixing block; 11, adjusting screw; 12, square netting pipe profile, 13, upright rod end cap; 14, box body netting fixing block; 15, limiting rod; 16, LED modular lamp bead fixing block; 17, cross rod end cap; 18, box body; 19, table surface; and 20, U-shaped groove.

DETAILED DESCRIPTION

The technical solutions of the embodiments of the present utility model will be described clearly and completely with reference to the drawings of the embodiments below. Apparently, the described embodiments are merely part of the embodiments of the present utility model, but not all of them. All other embodiments obtained by a person skilled in the art based on the embodiments of the present utility model without creative efforts shall belong to the protective scope of the present utility model.

Referring to FIGS. 1-4, the present utility model provides a technical solution as follows. A dual-use side-lighting netting lamp box comprises a box body 18, wherein the box body 18 consists of a top frame structure and a bottom frame structure. The top frame structure is formed by assembling short cross rod profiles 2 and long cross rod profiles 9 through top netting fixing blocks 1; and the bottom frame structure is formed by assembling other short cross rod profiles 2 and other long cross rod profiles 9 through bottom netting fixing blocks 6. There are four groups of the top netting fixing blocks 1 and the bottom netting fixing blocks 6 corresponding to each other. The four top netting fixing blocks 1 and the corresponding four bottom netting fixing blocks 6 are connected through upright rod profiles 3. A cross rod netting fixing block 10 is mounted at the inner side of the long rod cross rod profile 9 of each of the top and bottom frame structures through a cross rod end cap 17; and an upright rod netting fixing block 4 is mounted at the inner side of each upright rod profile 3 through an upright rod end cap 13. A table surface 19 is mounted at the top of the box body 18; and a box body netting fixing block 14 is mounted at the center of each of the front side surface and the rear side surface of the box body 18. The top netting fixing blocks 1, the upright rod netting fixing blocks 4, the bottom netting fixing blocks 6, the cross rod netting fixing blocks 10 and the box body netting fixing blocks 14 are connected into a crossed mesh structure through square netting pipe profiles 12. Feet 7 are mounted at the two lower ends of the bottom frame structure of the box body 18, respectively, and an LED modular lamp bead 8 is mounted on the upper surface of the bottom frame structure of the box body 18 through an LED modular lamp bead fixing block 16. Another LED modular lamp bead 8 is mounted on the lower surface of the top frame structure of the box body 18 through another LED modular lamp bead fixing block 16. A parallel wiring groove 5 is formed in one side of the two LED modular lamp beads 8; and the two LED modular lamp beads 8 are electrically connected with each other through a wire in the parallel wiring groove 5.

In this embodiment, preferably, an adjusting screw 11 is mounted at the bottom of the cross bar netting fixing block 10, so as to facilitate the limiting and fixing of the cross bar netting fixing block 10.

In this embodiment, preferably, the box body netting fixing blocks 14 on the front and rear side surfaces of the box body 18 correspond to each other, and are connected through limiting rods 15. The box body 18 adopts a frame structure. The box body netting fixing blocks 14 are suspended through the cooperation of the limiting rods 15 and the square netting pipe profiles 12. The limiting rods 15 can maintain the overall stability of the box body 18, and can prevent the deformation of the box body 18 caused by invagination of the box body netting fixing blocks 14 when an external stretched fabric is tensioned.

In this embodiment, preferably, lamp beads are intensively mounted on the inner side surface of the LED modular lamp bead 8, and are electrically connected with an external power supply through a power supply switch. A suitable power supply may be provided according to the total power of the arranged lamp beads.

In this embodiment, preferably, a U-shaped groove 20 is formed in the outer side edge of the upright rod 3, and the stretched fabric is embedded into the U-shaped groove 20 through a silica gel strip. The outer surface of the stretched fabric is painted with a color or pattern. The color or pattern of the stretched fabric at four sides is more eye-catching and bright when being illuminated by light at the two sides of the lamp box.

In this embodiment, preferably, the interior of the lamp box is lit through light at the upper side and the lower side by using the high-power LED modular lamp beads. The brightness and the evenness of the light are excellent, so that the lighting effect of the lamp box can be the best.

The working principle of the lamp box is as follows. The lamp box provided by the present utility model is safe and convenient to use. After correctly distinguishing all of the components, a user can assemble the components correctly according to the instructions. The lamp box can work normally after being powered on. When in use, the table surface 19 at the top is detachable. After the table surface 19 is removed, the stretched fabric is embedded into the U-shaped groove 20 through the silica gel strip, and is tensioned. Here, the lamp box is used as the separate lamp box. When the table surface 19 is mounted, the lamp box becomes a lamp box table. Therefore, the lamp box is very convenient to use; the dual-use function is realized; the functionality of the lamp box is obviously improved; and the resource utilization rate is high.

Figure 4:
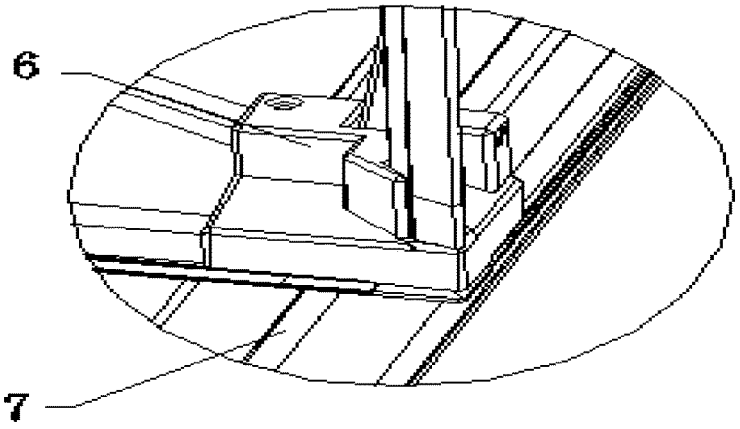
FIG. 4 is a partial enlarged view of a portion B in FIG. 2.

In addition, as the box body 18 is assembled by the profiles in segments, iron sheets may be embedded into the top netting fixing blocks 1, the upright rod netting fixing blocks 4, the bottom netting fixing blocks 6, the cross rod netting fixing blocks 10 and the box body netting fixing blocks 14; and further, powerful magnets may be embedded into the upright rod end caps 13 and the cross rod end caps 17. Thus, the stability of the overall structure of the lamp box is further improved, and the practicality is enhanced. As shown in FIG. 4, when the whole box body 18 is used as the lamp box table, the upright rod profiles 3 may be replaced with upright rod profiles whose outer side edges adopt cone-shaped arc structures, so that the corners will be more clear when the pattern on the stretched fabric is supported by the upright rod profiles, and the integrity of the pattern can be ensured. The lamp box provided by the present utility model is stretchable and extensible in the horizontal and vertical directions by additionally arranging the same components thereof; and the feet can be selected according to the size of the lamp box.

Although the embodiments of the present utility model have been shown and described, it will be understood by those skilled in the art that various changes, modifications, alternatives and variations may be made to these embodiments without departing from the principle and spirit of the present utility model. The scope of the present utility model is defined by the appended claims and equivalents thereof.

What is claimed is:

1. A dual-use side-lighting netting lamp box, comprising: a box body, wherein the box body includes of a top frame structure and a bottom frame structure; the top frame structure is formed by assembling short cross rod profiles and long cross rod profiles through top netting fixing blocks; the bottom frame structure is formed by assembling other short cross rod profiles and other long cross rod profiles through bottom netting fixing blocks; there are four groups of the top netting fixing blocks and the bottom netting fixing blocks corresponding to each other; the four top netting fixing blocks and the corresponding four bottom netting fixing blocks are connected through upright rod profiles; a cross rod netting fixing block is mounted at the inner side of the long rod cross rod profile of each of the top and bottom frame structures through a cross rod end cap; an upright rod netting fixing block is mounted at the inner side of each upright rod profile through an upright rod end cap; a table surface is mounted at the top of the box body; a box body netting fixing block is mounted at the center of each of the front side surface and the rear side surface of the box body; the top netting fixing blocks, the upright rod netting fixing blocks, the bottom netting fixing blocks, the cross rod netting fixing blocks and the box body netting fixing blocks are connected into a crossed mesh structure through square netting pipe profiles; feet are mounted at the two lower ends of the bottom frame structure of the box body, respectively; an LED modular lamp bead is mounted on the upper surface of the bottom frame structure of the box body through an LED modular lamp bead fixing block; another LED modular lamp bead is mounted on the lower surface of the top frame structure of the box body through another LED modular lamp bead fixing block; a parallel wiring groove is formed in one side of the two LED modular lamp beads; and the two LED modular lamp beads are electrically connected with each other through a wire in the parallel wiring groove.

2. The dual-use side-lighting netting lamp box of claim 1, wherein an adjusting screw is mounted at the bottom of the cross rod netting fixing block.

3. The dual-use side-lighting netting lamp box of claim 1, wherein the box body netting fixing blocks on the front and rear side surfaces of the box body correspond to each other, and are connected with each other through a limiting rod.

4. The dual-use side-lighting netting lamp box of claim 1, wherein LED beads are intensively mounted on the inner side surface of the LED modular lamp bead.

5. The dual-use side-lighting netting lamp box of claim 1, wherein a U-shaped groove is formed in the outer side edge of the upright rod profile, and a stretched fabric is embedded into the U-shaped groove through a silica gel strip.

* * * * *